US012006625B2

(12) United States Patent
Zornow

(10) Patent No.: US 12,006,625 B2
(45) Date of Patent: Jun. 11, 2024

(54) FACILITATING THE ASSEMBLY OF GOODS BY TEMPORARILY ALTERING ATTRIBUTES OF FLEXIBLE COMPONENT MATERIALS

(71) Applicant: Sewbo, Inc., Seattle, WA (US)

(72) Inventor: Jonathan Michael Zornow, Seattle, WA (US)

(73) Assignee: SEWBO, INC., Seattle, WA (US)

( * ) Notice: Subject to any disclaimer, the term of this patent is extended or adjusted under 35 U.S.C. 154(b) by 853 days.

(21) Appl. No.: 16/179,845

(22) Filed: Nov. 2, 2018

(65) Prior Publication Data

US 2019/0234010 A1 Aug. 1, 2019

Related U.S. Application Data

(63) Continuation of application No. 14/652,436, filed as application No. PCT/US2013/075085 on Dec. 13, 2013, now Pat. No. 10,132,027.

(Continued)

(51) Int. Cl.
*D06B 1/00* (2006.01)
*D06B 15/00* (2006.01)

(Continued)

(52) U.S. Cl.
CPC ..... *D06H 1/02* (2013.01); *D06B 1/00* (2013.01); *D06B 15/00* (2013.01); *D06C 23/04* (2013.01);

(Continued)

(58) Field of Classification Search
None
See application file for complete search history.

(56) References Cited

U.S. PATENT DOCUMENTS 2,220,508 A 11/1940 Bock et al.
3,559,253 A 2/1971 Pandell et al.

(Continued)

FOREIGN PATENT DOCUMENTS

CN 1385573 A 12/2002
CN 1505718 A 6/2004

(Continued)

OTHER PUBLICATIONS

Fabric Testing; Fabric Chemical Testing; Q. Fan; 2008, pp. 125-147; ISBN 9781845692971; https://doi.org/10.1533/9781845695064.125; accessed at https://www.sciencedirect.com/science/article/pii/B978184569297150005X.*

(Continued)

*Primary Examiner* — Michael P. Rodriguez
(74) *Attorney, Agent, or Firm* — DLA PIPER LLP (US)

(57) ABSTRACT

The invention aims to improve the manufacture of flexible goods, such as garments, through the temporary modification of the physical properties of the components to be assembled, facilitating their handling and manipulation later on in the manufacturing process. Attributes that can be affected by this process are the stiffness of the material, the presence of mechanical or physical markings, the density of the material, the air or fluid permeability of the material, the responsiveness of the material to magnetic fields, or the adhesive nature of the material.

6 Claims, 10 Drawing Sheets

Related U.S. Application Data

(60) Provisional application No. 61/736,796, filed on Dec. 13, 2012.

(51) Int. Cl.
*D06C 23/04* (2006.01)
*D06H 1/00* (2006.01)
*D06H 1/02* (2006.01)

(52) U.S. Cl.
CPC ..... *D06H 1/00* (2013.01); *Y10T 156/10* (2015.01); *Y10T 156/1039* (2015.01); *Y10T 428/24612* (2015.01); *Y10T 428/2481* (2015.01); *Y10T 428/249921* (2015.04)

(56) References Cited

U.S. PATENT DOCUMENTS

| | | | | |
|---|---|---|---|---|
| 3,649,400 | A * | 3/1972 | Otuska et al. | D04H 18/02 156/253 |
| 3,782,309 | A * | 1/1974 | Lee | D05B 33/02 112/470.36 |
| 4,606,487 | A | 8/1986 | Douri | |
| 4,712,290 | A | 12/1987 | Lindsey et al. | |
| 4,756,261 | A | 7/1988 | Gershoni | |
| 4,860,900 | A | 8/1989 | Forschner | |
| 6,101,962 | A | 8/2000 | Hinshaw et al. | |
| 6,302,181 | B1 * | 10/2001 | Rupel | E06B 9/262 160/DIG. 7 |
| 6,708,880 | B1 | 3/2004 | Acher et al. | |
| 10,132,027 | B2 | 11/2018 | Zornow | |
| 2002/0004347 | A1 | 1/2002 | Jost et al. | |
| 2002/0133924 | A1 | 9/2002 | Cohen et al. | |
| 2004/0062897 | A1 | 4/2004 | Samii | |
| 2007/0098898 | A1 | 5/2007 | Wu | |
| 2008/0190808 | A1 | 8/2008 | Patel et al. | |
| 2014/0144795 | A1 * | 5/2014 | Krieger | D06M 23/14 206/229 |

FOREIGN PATENT DOCUMENTS

| | | | |
|---|---|---|---|
| CN | 101035946 | A | 9/2007 |
| DE | 1660078 | | 4/1971 |
| DE | 4303820 | A1 | 8/1994 |
| DE | 4343230 | A1 | 6/1995 |
| DE | 4343230 | C2 | 8/1996 |
| EA | 200701989 | A1 | 4/2008 |
| GB | 496533 | | 12/1938 |
| GB | 497518 | | 12/1938 |
| GB | 910307 | | 11/1962 |
| GB | 1202550 | A | 8/1970 |
| JP | S60151382 | A | 8/1985 |
| JP | S61289104 | A | 12/1986 |
| JP | 62-102796 | | 5/1987 |
| JP | H05508196 | A | 11/1993 |
| JP | H07197387 | A | 8/1995 |
| JP | H09170107 | A | 6/1997 |
| JP | H10266073 | A | 10/1998 |
| JP | 6473693 | | 2/2019 |
| RU | 2023096 | C1 | 11/1994 |
| SU | 1391875 | A1 | 4/1988 |
| SU | 1724001 | A3 | 3/1992 |
| WO | 0056553 | A1 | 9/2000 |
| WO | 02086227 | | 10/2002 |
| WO | 2018129217 | | 7/2018 |

OTHER PUBLICATIONS

Second Examination Report dated Oct. 23, 2019 for counterpart European Patent Application No. 13863045.4 (5 pages).
First Office Action dated Sep. 10, 2019 for counterpart Brazilian Patent Application No. BR 11 2015 013926 4 (4 pages).
First Examination Report dated Sep. 17, 2019 for counterpart Indian Patent Application No. 6034/DELNP/2015 (6 pages).
Extended European Search Report dated Jan. 4, 2017 for counterpart European Patent Application No. 13863045.4 (11 pages).
First Examination Report dated Feb. 2, 2019 for counterpart European Patent Application No. 13863045.4 (5 pages).
Making Sense of Stabilizers; Threads Magazine #98 pp. 54-57; Nov. 3, 2008; retrieved from http://www.threadsmagazine.com/2008/11/03/making-sense-of-stabilizers.
Official Decision of Grant, dated Feb. 8, 2019 for Russian Patent Application No. 2015127994 (19 pages).
International Preliminary Report on Patentability for International Application No. PCT/US2013/075085, dated Jun. 25, 2015, 6 Pages.
International Search Report and Written Opinion for International Application No. PCT/US2013/075085, dated Apr. 10, 2014, 8 Pages.
Office Action for European Patent Application No. 13863045.4, dated Feb. 13, 2023, 11 pages.
Office Action received for Counterpart Australian Patent Application No. 2013359009, dated Oct. 18, 2017, 6 Pages.
Office Action received for Counterpart Chinese Patent Application No. 201380072705.8, dated Dec. 13, 2017, 12 pages.
Office Action received for Counterpart Chinese Patent Application No. 201380072705.8, dated Jun. 15, 2017, 14 Pages.
Office Action received for Counterpart Japanese Patent Application No. 2015-548002, dated May 14, 2018, 8 Pages.
Office Action received for Counterpart Japanese Patent Application No. 2015-548002, dated Sep. 27, 2017, 46 Pages.
Office Action received for Counterpart Russian Patent Application No. 2015127994, dated Dec. 8, 2017, 14 Pages.
On embroidery stabilizers of Madeira company. Mar. 20, 2012 [online] [retrieved on Mar. 13, 2014] Retrieved from the Internet: URL: http://www.sewings.ru/ovyshi valnyh -stabilizatorah -phirma-madejra-madeira.html.
Partial Supplementary European Search Report for European Application No. 13863045.4, dated Sep. 27, 2016, 8 Pages.

* cited by examiner

FACILITATING THE ASSEMBLY OF GOODS BY TEMPORARILY ALTERING ATTRIBUTES OF FLEXIBLE COMPONENT MATERIALS

CROSS-REFERENCE TO RELATED APPLICATIONS

This application is a continuation of U.S. patent application Ser. No. 14/652,436, filed Dec. 13, 2013, which application is a US National Stage application of International Application No. PCT/US2013/075085, filed Dec. 13, 2013, which claims the benefit of U.S. Provisional Patent Application No. 61/736,796, filed Dec. 13, 2012, all of which are hereby incorporated by reference in their respective entirety.

FIELD OF THE INVENTION

The present invention is directed to the field of manufacture of goods from components that are flexible, elastic, or have a loose composition, and thus are difficult to manipulate mechanically.

BACKGROUND AND RELATED ART

Flexible materials, like textiles, present a challenge for mechanically aided manufacturing processes. For this reason, the industrial manufacture of any product that uses primarily flexible materials, like garment production, is currently dominated by laborers assembling the garments manually, with the help of machines for specific steps.

Although there are numerous automatic processes for performing specific steps in garment production, like the cutting of components or the addition of buttons, button holes, pockets, etc., they all require human intervention at numerous steps along the way to facilitate the automatic processes. (Positioning the garment on a jig for the machine, for example.) This has left an unrealized opportunity for further efficiency in manufacturing.

SUMMARY OF INVENTION

This invention aims to aid production of flexible products, by bridging the gap in between the currently automated processes, and to facilitate further developments in automatic manufacture of flexible products. This is obtained by the temporary modification the physical and visual attributes of the material so that it can be more easily manipulated during production.

Attributes that can be affected by this process are the stiffness of the material, the presence of mechanical or physical markings, the density of the material, the air or fluid permeability of the material, the responsiveness of the material to magnetic fields, or the adhesive nature of the material.

This process is applied prior to, or during, the assembly of the product. The modified attributes of the material being treated will allow for easier manufacture using techniques developed for working with rigid materials, such as gripping and positioning by robots, stamping, roll-forming, crimping, etc., in conjunction with techniques traditionally used for flexible good manufacture—sewing, riveting, fusing, etc.

DESCRIPTION OF INVENTION

Figure 1:
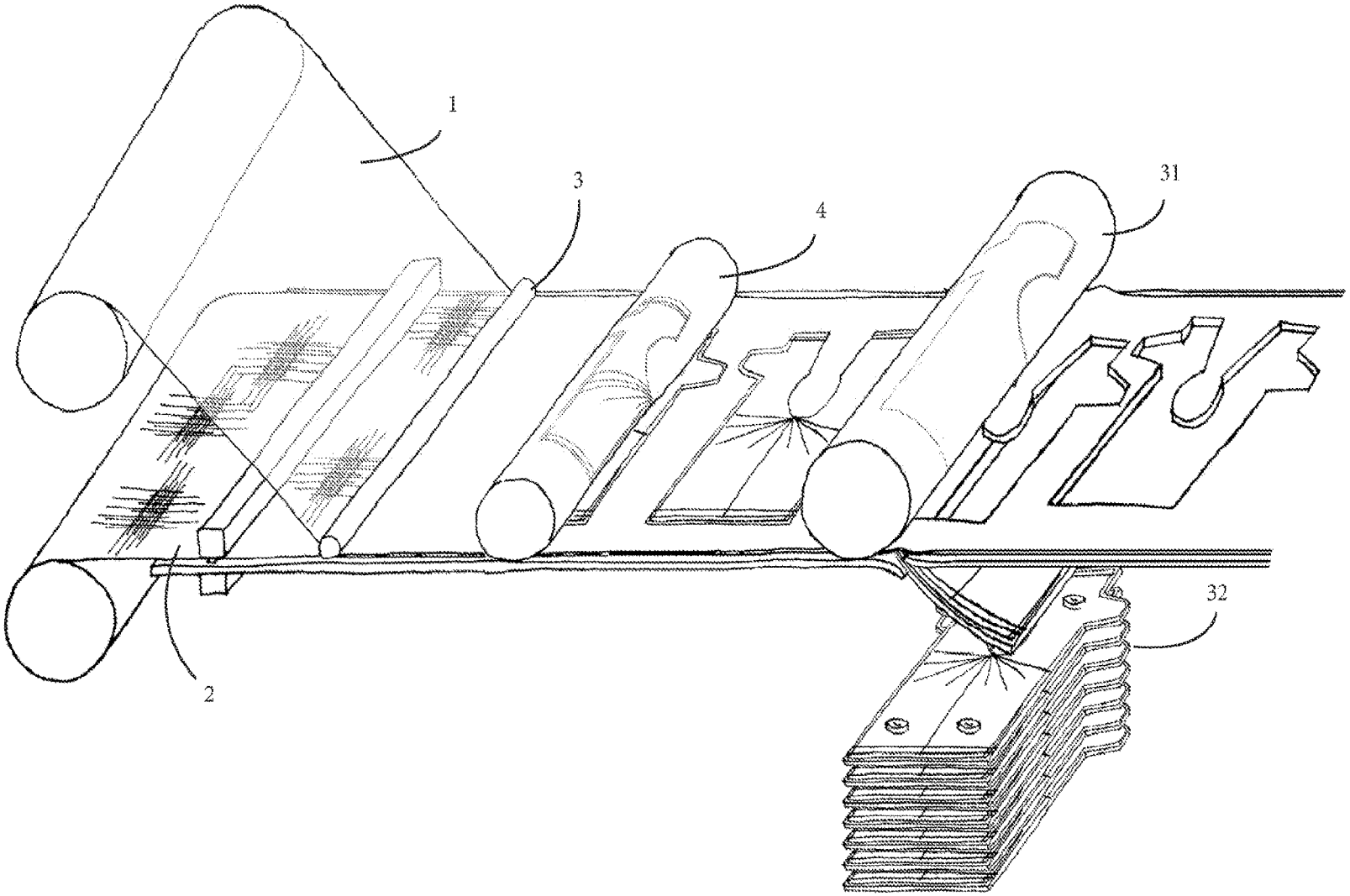
FIG. 1 is an example of a laminated, heat-softened posing agent application and its subsequent embossing by a textured roller and excision, by rolling cutter, of components from the contiguous textile.

This invention aims to aid production of flexible products as and to facilitate further developments in automatic manufacture of flexible products.

The method was developed with the goal of autonomous mass production of garments, but should serve for numerous other applications in the production of a wide range of goods—anything that contains a flexible material—everything from garments to sailboats' sails, to luggage, camping tents, kites, or upholstered furniture.

The technique can also be used to manufacture precursor components for composite materials that require a woven substrate/component, like resin-impregnated carbon fiber or fiberglass constructs.

Elements of the method can be useful at any scale of production, from by-hand application to computer controlled rapid prototyping to continuous full-scale, fully autonomous industrial production.

With the goal of manipulating and altering the flexible material in the easiest possible manner, this process consists of taking the flexible material and imbuing it with temporary attributes thus constituting a working material to aid in manufacturing.

Enhancements made to the materials' properties include adding visual or mechanical markings so a workman or camera-guided robot can accurately position it, adding a magnetically responsive material to aid in grasping by magnetic fields, by rendering the material less permeable to gasses or fluids for manipulation by pneumatic, vacuum or hydraulic methods, by altering the density of a material, or—in what will probably be the most useful application—by altering the rigidity of the material so that it can be mechanically formed and manipulated.

The material can be made temporarily rigid by the addition of a treatment material, alerting of the environmental variables in which the material is processed, or any combination of the two.

The treatment material, herein referred to as a posing agent is applied to the textile to facilitate subsequent assembly steps. A posing agent needs to meet the following criteria:

- It must be chemically inert when it's placed in direct, prolonged contact to the textile—even under heat and pressure—and not cause any deleterious effects to the garments being assembled, or the machinery and/or workers doing the assembling.
- It must be temporarily bondable to the textile, but must also be removed without damaging the textile substrate. Therefore it must either be easily mechanically separable, or be soluble in a material that does not affect or interact with the textile substrate It must be pliable and position-able—either by the application of direct pressure in significant excess of the normal force of gravity and reasonable handling forces, or by the application and subsequent removal of heat, solvent, electric fields or magnetic fields. It must be able to withstand as many reforming states as the assembly process requires without significant degradation It should be recoverable and recyclable, or barring that as disposable as possible—requiring as few steps, and as little energy, as possible to render safe for disposal Possible Agents These criteria leave a lot of options on the table, so it's worth considering a wide range of materials for the role of posing agent. Perhaps the most straightforward scenario is one in which water is used as the posing agent, and temperature being used as a method to control its stiffness. The textile can be soaked in water, frozen, manipulated by a machine, partially headed along an intended bend line, bent, refrozen, and so on. The water can eventually be removed at the end of the manufacturing process by evaporation.

Similarly simple scenarios can be envisioned using common water-soluble materials like table salt or starch. The textile can be treated with a high concentration solution of either of these materials, and be allowed to dry and stiffen. The textile would then be treated along a bend line with a small amount of appropriate solvent (in this case, water), and allowed or encouraged to re-harden. The posing agent would be removed at the end of assembly by rinsing with a suitable solvent: again, in this case, water.

Another type of posing agent would be a thermoplastic material that melts at or near room temperature. There are a number of organic or inorganic waxes and natural and synthetic polymers that have this property. They could be applied to the textile, and then heated slightly and softened along the bend lines. After assembly, the plastic can be washed away using water and surfactant, a suitable solvent, or some combination of the two.

One desirable, but not critical, property of a posing agent is a degree of permanent pliability at room temperature—giving the ability to deform a piece and have it stay that way. For example, a thin sheet of metal foil, coated with an adhesive and bonded to the textile, would serve this purpose. It could be molded and manipulated, and removed via electrolytic or chemical dissolution after assembly. The adhesive bonding the metal and textile would also have to be removed via solvent.

In addition to the practical posing agents discussed thus far, there are also a number of less practical, but still conceivably applicable, materials that might be considered for this role: Ferrofluids, which respond to magnetic fields, could be used to coat the textile. Alternately, a rheopectic or dilatant non-Newtonian fluid, like cornstarch and water, whose viscosity is increased dramatically by the application of mechanical stress, could be applied and then locked into shape by the application of mechanical forces or an acoustic field, and allow a formed garment piece to retain its shape for, or at least limit the degree of deformation during, a short period of time. These examples are likely to be overly complicated and unlikely to see use, but still serve to demonstrate the range of materials that might be considered for the role of posing agent.

Polyvinyl Alcohol

Of the materials thus far considered for the role of posing agent Polyvinyl Alcohol is the best candidate—it meets all of the aforementioned criteria when applied to the appropriate textiles. It is a water-soluble thermoplastic that's available in industrial quantities, and in fact, is already in wide use as a sizing agent in the textile manufacturing process. Further to its merit for the role, it can be fully recovered at the end of the manufacturing process and reused in the future. (Gupta, 2009)

For the sake of simplifying the discussion, the rest of the document will assume that polyvinyl alcohol is being used as the stiffening agent. For steps that require that the bonded posing agent and textile be formed, the polyvinyl alcohol will be heated, formed, and allowed or encouraged to cool. For other materials, their corresponding process for manipulation should be used instead.

Agent Application

The agent can be applied from a roll as a film and laminated onto the surface of the textile or deposited as a liquid, in molten state or in solution, directly onto the textile. The advantage of using a premade film is that its manufacture is separated from the subsequent assembly steps, and does not need to be synchronized with overall operation scheduling, textile feed speeds or variable cutting rates, and can be applied and almost immediately used, avoiding a delay for cooling from molten state or solvent evaporation.

An example of a laminated, heat-softened, posing agent application is demonstrated in FIG. 1. A film of posing agent (1) is fed from onto limp textile (2) as it passes underneath. The posing agent is softened by a heat source, prior to the compression of the softened posing agent onto the textiles surface by a rolling drum, which can either be flat (3), and impose a uniform lamination; or textured (4), and impose an embossed surface.

The advantage of directly depositing the agent to the textile is that it's logistically and energy efficient and minimizes the number of steps and mechanisms that need to be implemented and monitored in the manufacturing process. The tradeoff, however, is that of added technical complexity in that the application mechanisms must be synchronized perfectly with the textile feed rates to ensure a consistent and even coating.

For most applications, laminating a plastic film onto the textile, in one or more layers, is likely to be the preferable option. In situations that call for it, however, the plastic can be deposited in molten state or in solution onto the film via curtain coating, screen-printing, spraying, or immersion. The plastic added in powdered solid form and then sintered together, and to the textile, under moderate heat and pressure.

Prior to and during the treatment of the textile with plastic, the tension in the textile substrate should be monitored and controlled to prevent deformation down the line. Textiles can be intentionally stretched to a desired tension or left at their neutral, resting tension, and the desired tension should be maintained until the textile and plastic laminate has fully cooled.

Since the plastic application may damage some of the initial aesthetic and haptic properties of the material, like its hand, luster, etc., the assembly process should be engineered so that the plasticized surfaces are not on the outside of the finished garment. Alternately, fabric treatments for these characteristics can be applied after assembly, when the posing agent has been removed.

After treatment with this process, components of a product will be formed from sheets of material. They can then be assembled and joined together. The assembled, or partially assembled, garment can then be worked over using extant textile joining and forming techniques, like sewing, hemming, fusing, riveting, gluing, pleating, darting, etc.

Agent Application onto Non-Flat Pieces

The previous example assumed that the textile was entering the manufacturing process flat, off of a roll. Although this is often the case; there are circumstances in which posing agent would need to be applied to a piece that was not flat—particularly in the case of knitted garment components that would be joined to woven components—like shirt cuffs, shirt necks, or certain collars for collared t-shirts.

In this scenario, the posing agent must be applied to the three-dimensional component in a different manner than the one described earlier. Knitted components can be placed on a mandrel resembling their desired form, and then be wrapped, soaked, or sprayed with a posing agent. The posing agent is allowed to harden, and then the component can join the assembly process.

Once the components have been joined, the temporary attributes are removed, leaving a completed product.

Posing Agent Recovery

If possible, the posing agent should be recovered for subsequent reuse. If the agent is in solution, the solution should first be filtered to remove any fibers that may have come off of the garments' textile components during assembly.

Once any solid contaminants have been removed from the solution, the posing agent can be recovered by evaporating the solvent, leaving the agent behind. This can occur through several commonly used techniques, such as vacuum evaporation (Gupta, 2009), spray or drum drying, or traditional distillation. The technique used should not employ heat that exceeds or approaches the pyrolyzation temperature of the posing agent.

After it has been recovered, the posing agent should be evaluated for contamination and degradation—though spectrographic analysis and standard material science tests, Once baseline contamination and degradation rates are determined, systematic tracking of the number of times a batch of posing agent has been used with a particular assembly process can be used to predict when it must be either refined or disposed.

In the preferred embodiment of this method, the flexible material can be laminated with a thermoplastic film that would cause it to become rigid. The rigid material can then be softened by heat and formed into the desired shapes of the components. The components can then be worked over using methods developed for working with rigid materials, like sheet metal or heavy plastic, such as gripping by robots or humans, stamping, roll-forming, crimping, hydroforming, vacuum forming, etc., in preparation for their final assembly.

Pre-Forming

Interfacing and Linings

Many garments are assembled from one or more layers of textile laid over each other. This is done for several reasons: For aesthetics—to control the stiffness of the garment (and thus the manner in which it hangs off the wearer), to reinforce the garment in structurally important locations (like button-holes), to prevent the textile from stretching to the point of permanent deformation, and to provide additional thermal insulation. Depending on the application, interfacing and linings may be joined at their perimeter, or fused together along some or all of their mutual surface area.

In the context of this process, additional layers are prepared in a manner similar to the laminating and cutting techniques previously described. After being positioned atop the primary piece, their relationship is fixed either permanently using standard fusible interfacing techniques, like an activated adhesive, or temporarily, using a soluble adhesive, a spot weld by softening the posing agent and pressing the interfacing onto the main piece at the softened location, or by mechanical fasteners made from the same removable material as the posing agent.

Commonly used interfacings are fused with thermally activated adhesive—since this may interfere with the posing agent, it may be necessary to apply fused layers prior to the process that sets the posing agent's thickness, or alternately use a non-thermally activated adhesive, like a UV- or catalyst-activated adhesive.

In the case of fusible linings, the textile and interfacing surfaces must be in direct contact with each other, and cannot have a layer of stiffening agent in between. In this scenario, the interfacing must be handled, positioned, and fastened while limp—although once fastened, it will benefit from the posing agent applied to the primary piece.

Since interfacing is often used to determine structural characteristics of a garment, it is important that the bulk to the layered materials added by the posing agent be minimized. This can be done by forgoing the application of posing agent to the interfacing, and just using the fastening techniques discussed earlier in this section, but it can also be achieved by varying the thickness of the posing agent in coordination with the corresponding posing agent's surface on the adjacent layer. Interlocking posing agent applications can minimize overall bulk without completely sacrificing the handling advantages of the posing agent.

Looser materials, like batting or insulation, can also be handled by this process: they can be treated with the stiffening agent and then compressed into thin sheets for handling.

Bulky Material

Bulky textiles, like batting/insulation, either loose or in a sheet, can be prepared for handling in this process by treating it with the posing agent and compressing it between rollers or a die while the posing agent hardens. Once the material has been treated, it will resemble a non-woven textile, and can be cut and handled like the other textile pieces. After the posing agent is removed, if an accommodating space is left between the garment layers, the material will return to its normal volume. Care should be taken to ensure that the material being treated will not permanently deform when exposed to the temperatures and pressures applied during manufacture.

Figure 2:
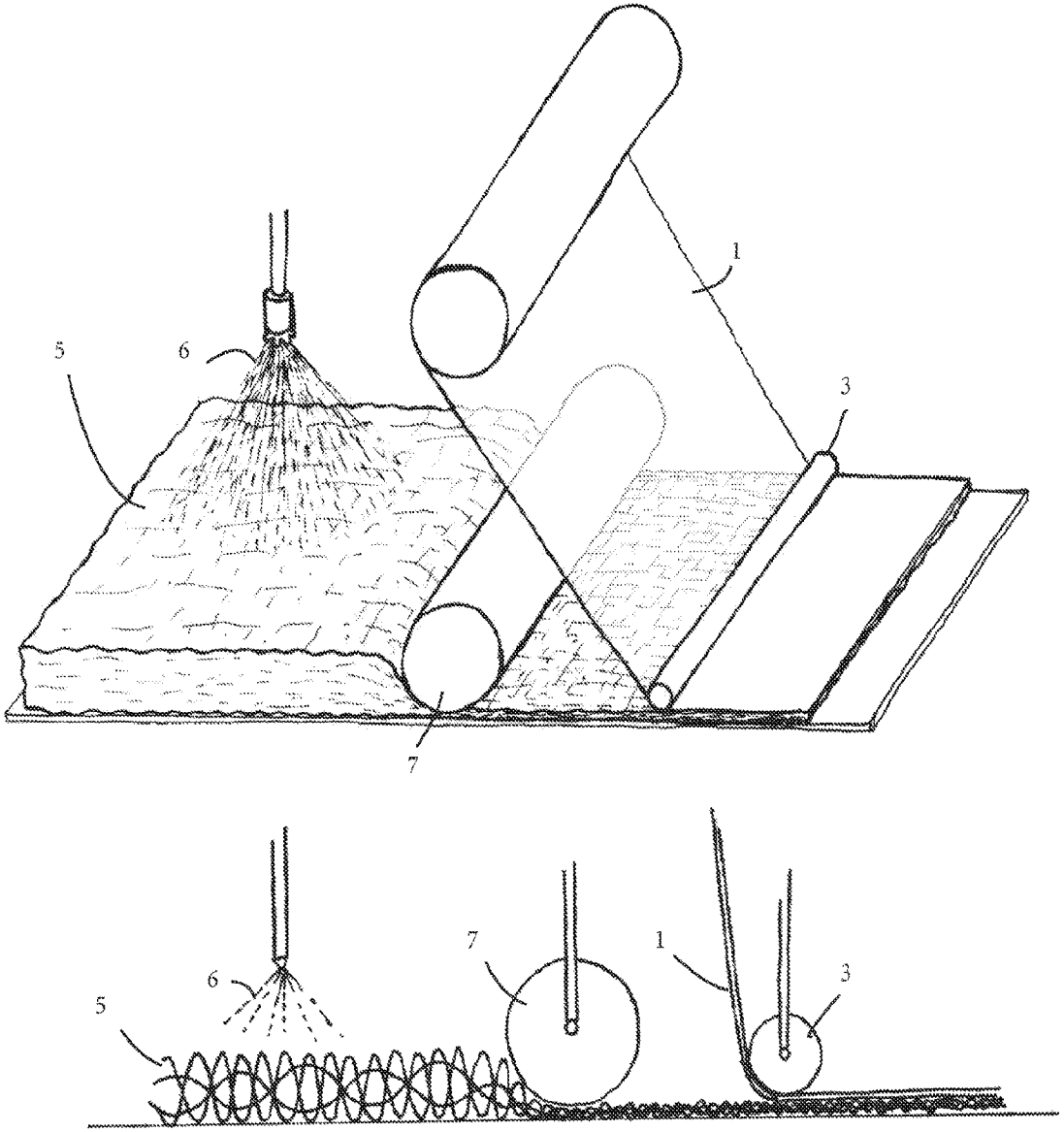
FIG. 2 depicts a loose, bulky material as it passes underneath a spray nozzle of either molten posing agent or posing agent in solution.

FIG. 2 depicts a loose, bulky material (5). As it passes underneath a spray nozzle of either molten posing agent or posing agent in solution (6), the loose material is coated with posing agent. The coated material is then compressed by a roller (7), temporarily altering the density of the material. This process can be enhanced if performed in a vacuum, to ensure that the volume is minimized.

Optionally, after or during compression treatment, the dense material can be given a secondary treatment of posing agent (1), deposited as a film and laminated by a second heated roller (3). This secondary treatment provides a uniformly sealed surface, which is advantageous for vacuum gripping, or any other forming or gripping methods that would benefit from an airtight surface.

Utility of Variable Posing Agent Thickness

The posing agent's thickness may vary in places to provide specific behaviors in subsequent assembly steps. The variation in thickness will provide areas of variable stiffness and flexibility where needed and should be optimized to minimize the weight of the posing agent used per application.

Structures rendered on the treated textile surface can interact with subsequently encountered machinery—acting as guide rail, track, or a toothed belt so it can be fed consistently and easily into a machine.

A variety of examples of variable posing agent thickness can be seen in FIG. 2 in which the textile (2), treated with the posing agent (1), has an articulation line running along its length (15). Additionally, the posing agent is thinned significantly along its seam flange (5), to minimize seam bulk and made to facilitate needle penetration with perforations (6) and a continuous trough (15). Also depicted are a structural reinforcement (14), and registration (12) and gripping (13) points.

FIG. 2 also depicts a variety of functional elements including smooth (10) and toothed (8) tracks embossed into its surface, which interface with corresponding components in the feeding and guiding mechanisms of various machinery (16).

Also depicted is a similar guide-rail molded into the treated textile (11), note that in this case, the treated textile itself has been molded into the rail, rather than having the rail molded onto its surface, accomplished with deep-relief embossing or a subsequent roll-forming or molding process.

Methods for Setting Posing Agent Thickness

Thickness can be determined via embossing, engraving, or etching, which would likely be determined by the scale of production:

Embossing

Embossing is accomplished with a surface textured as the negative of the final topology: Either as a plate or revolving cylinder, the textured surface is pressed into the pliable posing agent, displacing the agent from areas where it should be thin and depositing them where it should be thick. The embossing surface can either be heated or pressed into pre-heated agent.

Embossing has the advantage of being the highest efficiency and highest throughput technique, but has higher tooling costs and cannot be adjusted per-piece for applications requiring mass-customization.

Engraving

Engraving is accomplished by pressing a scribe into the posing agent. The scribe is then moved to trace a desired pattern into the agent, displacing the agent in its path. This can be performed by hand, or automated with a Cartesian plotter device.

Engraving can be useful in custom applications and experimental setups, but is limited by low speed/throughput and degree to which the posing agent can be displaced (engraving is suitable for adding lines—articulation creases and seam perforations, but wouldn't be able to remove a large, solid, area of material). The scribe can be applied while the posing agent is hot, or a heated scribe can be used against cool agent.

Etching

Laser etching is accomplished with commercially available laser etching machines. A computer controlled laser beam traces the surface, evaporating a thin layer of the agent with each pass.

Etching has the advantage of being extremely accurate, however, this is the only process that permanently removes the (otherwise recoverable) agent from the manufacturing cycle, and so might be undesirable in large-scale applications.

In additional to altering physical attributes, the system can apply visual and physical markings to assist manipulation down the line. Visual markings can include data-encoded one- or two-dimensional graphics (like QR codes or diagram/orientation guides) so a camera or worker can determine the intended position and orientation of any given part. Further markings can be used for precise alignment and registration when joining molded parts. Guide-lines can also be printed on the fabric to direct any number of processes—like sewing, cutting, folding, pocket-adding, button-adding, etc.

Physical markings can consist of graphics imprinted on the surface of the material, topological markings, or physical components that are temporarily attached to the surface of the material. Topological markings can also be dual purpose and perform non-informational roles, such as creases that serve as precursors to later joining, bending, crimping, darting, or pleating operations.

When used on materials that have an uneven surface that would preclude useful printing, the visual markings can be applied on top of a layer of the posing agent, which can be used as a more appropriate printing surface—sealing gaps, smoothing over textures, providing a chemically compatible surface, etc.

Topological markings, added physical components, or a combination of the two, can serve as aides to the action of an assembly process in the manner of a jig, registration points, guide rail or track, or a toothed rack so it can be fed consistently into a machine.

Doping

Depending on the complexity of the assembly process, it may be necessary to alter the characteristics of the posing agent layer to facilitate observation and interaction in subsequent steps.

The ability to selectively heat a piece, regardless of its accessibility or positioning, may be required to join, separate or reform a piece or pieces during assembly. Adding susceptors to the posing agent, a mixture of fine metallic and/or ferromagnetic particles into the posing agent, would allow it to be heated by exposure to electromagnetic radiation or induction heating.

If the metallic particles are magnetically responsive, like iron filings, then the doped patch can be gripped by an electromagnet.

If the posing material is instead mixed with a pigment, it can serve the role of an indicator, as described in the previous section. If the pigment is radio opaque, it can be used to scan the arraignment of the pieces in subsequent assembly steps and can provide helpful quality control feedback.

A pigment that fluoresces when exposed to ultraviolet light (12*b*), at appropriate concentrations in the posing agent, can be used to indicate the relative thickness of the posing agent across the piece's surface (11*b*). This information can be interpreted via machine vision or a human worker, and can be used to indicate helpful positional information (in a manner similar to the methods discussed in the previous section), as well as reveal any errors in the posing agent's application or the underlying textile's structure.

The addition of an opaque or translucent pigment in a color dissimilar to the textile being treated will allow for a contrasting pattern to be revealed once the posing agent's thickness is set. Areas of high contrast can be used to convey information to machine vision processes, and translucent pigments—which would vary, visually, by thickness of the posing agent—can be used to meter the posing agent's thickness for quality assurance purposes.

Applied Indicators

In complex, asynchronous assembly operations, it may be necessary to label individual parts with instructive information regarding the identity of a given piece, its intended orientation relative to the machine vision camera or assembly worker ("this end up"), and the relationship it should have to adjacent pieces—providing visual, instead of mechanical, registration markings.

Indicators are particularly useful in assembly operations that are not wholly automated and require some degree of human interaction. Guide-lines printed on the textile can direct any number of processes—like sewing, cutting, folding, pocket-adding, button-adding, etc.

The indicators can be applied in a temporary manner with pigments either printed directly onto the posing agent's surface, or mixed into the posing agent itself. The indicators can also be embossed solely as a texture onto the agent's surface, being revealed with the application of an oblique lighting source.

Topological indicating information can also be derived from surface modifications with non-informational roles, like the creases that serve as precursors to later joining, bending, crimping, darting, or pleating operations.

Indicators can consist of simple, informative geometric symbols—like diagrams, matching shapes, or simple numbers—or contain relatively complex information encoded in one or more machine-readable 1-dimensional or 2-dimensional barcodes.

Figure 4:
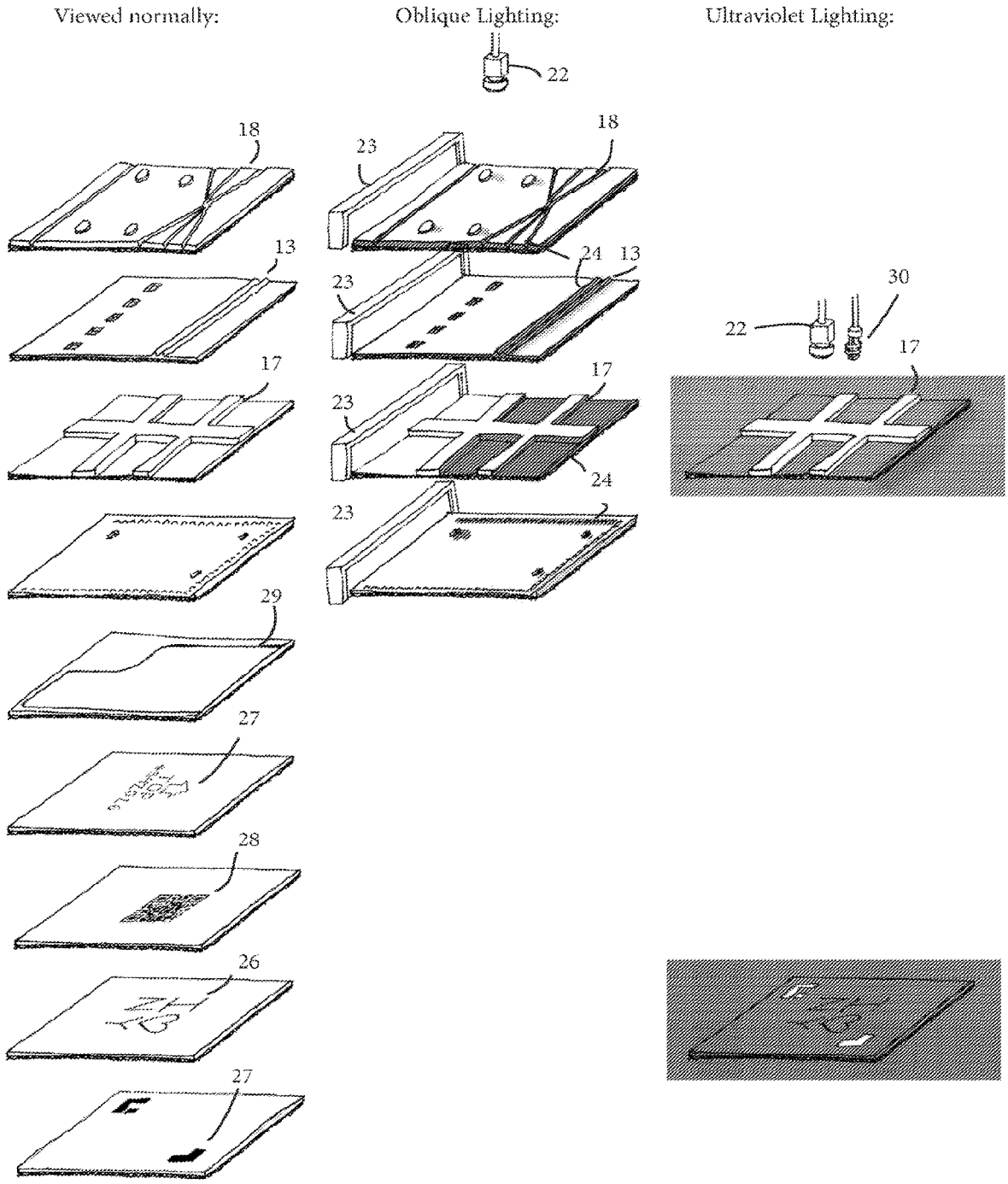
FIG. 4 depicts a variety of types of surface indicators.

FIG. 4 depicts a variety of types of surface indicators. Pieces of textile (2) treated with posing agent (1) are presented with patterns (21) embossed, printed, or enjoined onto their surfaces. Note functional "patterns", like articulation creases (18), gripping or registration points (15), embossed mechanical interaction guides like teeth or rails (13), and structural reinforcements (17), which can be imaged using a machine vision camera (2) coupled with an oblique, possibly collimated, light source (23). The characteristic shadows (24) cast by the various surface features can be used to indicate piece orientation with respect to the camera and any tooling or incoming effectors. Additionally, any aberrations in shadow placement would indicate errors in the piece, serving as an opportunity for quality assurance determinations.

Surface indicators can also be printed onto the piece using pigments, and interpreted by machine vision with standard lighting (25). Indicators printed onto the surface of the posing agent will be removed at the same time as the posing agent, during the washing stage, Decorative graphics printed directly onto the piece itself (26), which will stay on the garment permanently, can also be interpreted using common machine vision techniques.

Temporary markings can be simple geometric forms, like blocks or arrows (27), used to give generic positioning information, can contain data encoded in characters legible to optical character recognition software (or, of course, human operators), or can contain data encoded in 2- or 3-dimensional barcodes (28). Markings can also be used to convey practical guidelines to machines or operators—indicating the path that a hem-fold should follow, or alignment markings adorning the inside edge of a future seam (29). Similarly informative graphics can be embossed into the posing agent's surface, in a manner such that when lit obliquely, shadows are cast in the shape of the desired informative graphic (30).

Temporary Functional Surface Features

After the posing agent has been applied to a textile and its thickness has been set by embossing or methods, additional features can be added to the treated surface.

Functions

Registration Points

Registration points are functional surface features that allow two or more pieces to be positioned against each other with a high degree of precision. A tapered mating surface ensures that, as the two halves approach each other, they will be mechanically forced into alignment, similar in concept to center compliance mechanisms. Registration points can be used to ensure accurate positioning on interfaces between piece and piece, piece and jig, and piece and gripping effector—including actuated mechanical grippers and vacuum or electromagnetic effectors, Gripping Points Gripping points allow for a piece to be securely held in place by a gripping effector, jig, or adjacent piece without damaging or distorting the textile.

For shot-duration grips, a simple mechanical knob or handle can assist a machine to get a firm grip on a piece. For medium-duration grips, a cam lock could effectively hold and release. For longer-duration hold by gripping effector or jig, a screw socket would work well, to be secured by a bolt if repeated grips are required or a self-tapping screw if the gripping point is only used once.

It may be necessary for a gripped piece to have one or more axis of motion available during a manufacturing step. In this scenario, the gripping point would resemble a ball hitch or either half of a hinge, allowing a corresponding gripper to hold it securely in one or two axis of motion.

In the case of a gripping interface between two pieces, the bond can be held permanently (until the end of the assembly process) with a snap rivet, or temporarily with a hook and loop fastener.

It's worth noting that any gripping point would likely also include the functionality of a registration point.

Figure 3:
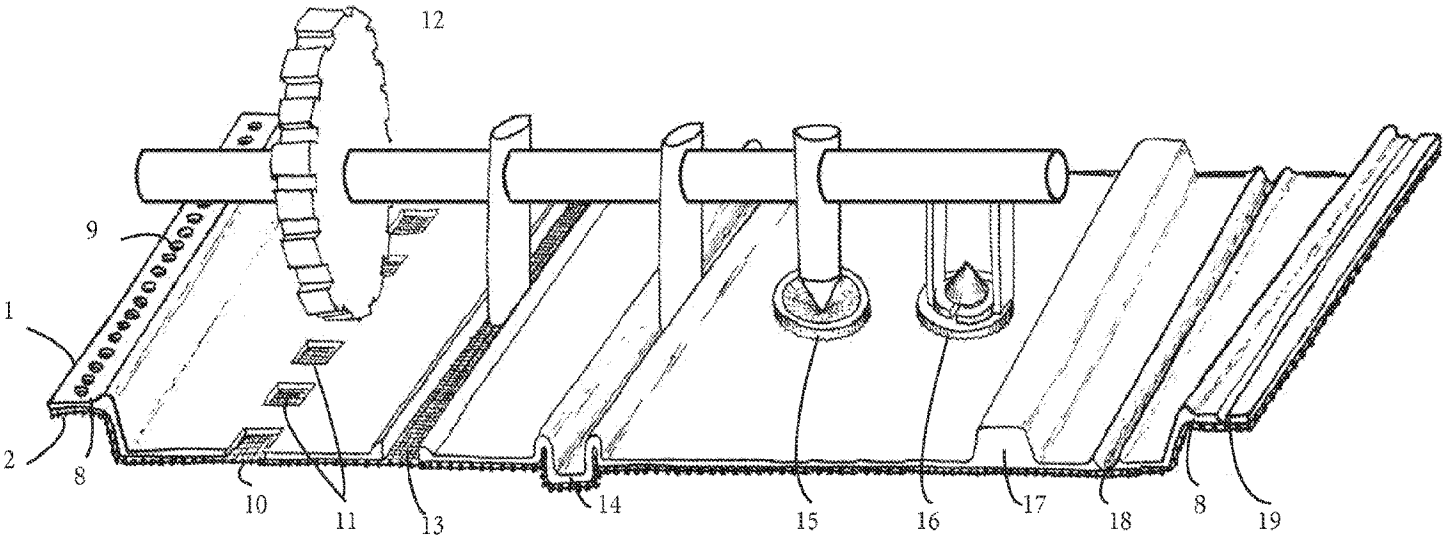
FIG. 3 depicts a textile treating with posing agent, configured into, and affixed with, a variety of functional surface features.
Figure 3:
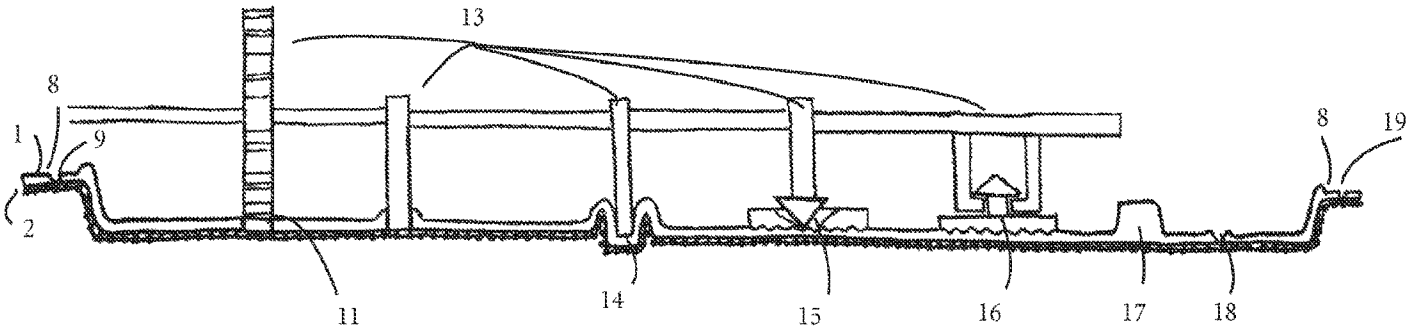

FIG. 3 demonstrates a registration (15) and gripping point (16) affixed to the surface of a textile (2) treated with a posing agent (1).

Types

Functional surface features can be added to a piece in one of three ways: They can be molded directly into the posing agent that already coats the textile, they can be injection molded directly onto the agent, or they can be made separately and then attached to the piece. If they're made separately and then applied, they can be made from the same agent that's used as a posing agent, or it can be made from a different material.

Only very simple registration points can be molded directly into the treated surface, they are impressed into the agent with a hot die or pressed into the textile while it's still hot.

More complex functional surface features require the application of additional materials—for some features, it may be expedient to injection-mold them directly onto the surface of the piece.

The most complicated features, like cam locks, may require separate manufacturing processes in advance of their placement on the piece.

If the separately molded piece is made from the same material as the posing agent, it can be joined to the surface with the application of heat from a blast of hot air, exposure to a heating element, infrared radiation, or RF heating—accompanied by pressure. The same effect could be achieved with an ultrasonic welding apparatus. Alternately, a small amount of solvent or temporary adhesive would bond the two surfaces together.

If the separately molded piece is made from a different material than the posing agent, its more likely that a temporary adhesive would be required to bond the surfaces. Alternately, a mechanical bond can be obtained by texturing the surface feature's bonding face and pressing it into the heated posing agent. Surface texture can be applied via machining, grinding, particle blasting, laser etching, or chemical treatment.

Surface features made from materials that are not dissolved along with the posing agent will fall off of the assembled garment at the end of assembly, when the posing agent that they're affixed to is removed. They can be recovered and reused. The material may be chosen for its specific properties—magnetically responsive materials would be required gripping points for electromagnetic gripping effectors, and a gripping point made from a flexible gasket material would mate well with a vacuum gripper.

Registration and gripping points can, and likely will, be mated with effectors equipped with remote center positioning mechanisms to correct for any variances introduced during any manufacturing steps, prior to subsequent operations.

Cutting

Cutting Techniques

The cutting room is where most of the high-tech and high-output optimization has occurred in industrial-scale garment manufacturing, and there is little improvement to be made here. Presently, cutting operations for garment assembly use handheld cutting tools, die-stamps presses, and CNC tools like plotter knives, laser cutters, and water jet cutters.

The only new cutting technique made available by the application of a posing agent is that of a rolling die cutter, which allows a high volume of pieces to be cut accurately from a plane, which may be necessary since most other bulk cutting techniques require that the textile be layered many times atop itself, which could be a limiting factor once the posing agent has been applied, since the many layers of posing agent will significantly add to the force required to cut through the stack. The relatively high tooling costs for this equipment would restrict its use to large production runs.

Collecting and Buffering

After cutting, the pieces should be collected and sorted for delivery to the assembly process (32). The machine-readable indications and functional surface features provide a means for a robot to recognize and pick up pieces after they've been separated from each other.

In high-volume streamlined manufacturing scenarios, the cut pieces can pass directly to the assembly phase, but in lower volume scenarios where available equipment is a limiting factor, it may be economical to have a single prep line producing all of the pieces for assembly.

Even in high-volume operations, it's helpful to consider a logical break between the prep and subsequent phases—in the event of a backup in the production process, this provides a good opportunity to buffer the pieces, since they can be stored in a stable, compact manner and consumed as needed once production resumes.

After the components have all been formed, they can be assembled together and joined using traditional textile methods, like sewing, fusing, or riveting.

Hemming and Folding

Garment edges are usually finished with a hem, by folding the textile back on itself one or more times and then securing the fold with adhesive or a sewn seam. This can be easily performed on textile treated with a posing agent, by softening the posing agent along the line to be folded, by taking advantage of creases made in the posing agent, or by a combination of the two.

The flat textile is fed through a folding guide, which bends the textile at the desired location and folds the hem back on itself. The hem can then be secured immediately with adhesive or a seam, or left in place—secured by the posing agent—and secured later. Multiple folding guides and sewing can be arraigned inline with each other to produce any arbitrary hem. As the textile exits the folding guide, a roller can compress the fold to further crease the textile.

Creases are often preserved and made permanent by the application of a "permanent press" treatment to the inside of the fold. If this step is going to be performed on a textile that's been treated with a posing agent, it is important to ensure that the crease preserver is applied to the non-treated face of the textile.

The folding guide, presently used for making hems on sewing machines (U.S. Pat. No. 1,988,140 A), has a broader potential use in conjunction with the posing agent treated textile. Stiffened textile of any size and dimensions can be folded linearly or along an arbitrary curve by passing it through a folding guide, an assembly step that is likely to see frequent use in practice.

Surface Features

Many garment surface features can be applied at this step, to take advantage of existing machines that can perform these tasks autonomously. Devices to add functional elements (like snap clasps, pockets, buttons, and button holes) or decorative elements (embroidery and printed graphics) are already in widespread use, and can be made to work with posing agent treated textile with minimal modifications.

Many of the current tools that are used to partially automate steps of a garment manufacturing process, such as Shirt pocket machines, presently require that a worker place onto and align the textile pieces on the device, before the automation takes over, automatically folding and sewing the pocket onto the textile. In this improved process, the increased manipulability of the treated textile allows for precise automated placement of pieces onto a machine, negating the need for a worker. The same is true for many other semi-automated processes in current use: This process allows for automated coordination with button and buttonhole machines, embroidery machines, and devices to apply any other decorative elements: Sequins, rivets, adhered glitter, etc.

The untreated surface of the rigid textile can be placed accurately onto a printing machine to receive a decoration using any of the standard printing or transfer techniques—screen printing, dye sublimation, pad printing, airbrush, or inkjet printing, along with any necessary post-printing curing steps.

Three Dimensional Forming

Shaping Pieces

The ability to temporarily mold the cut pieces is the principal advantage conferred by the posing agent, allowing the pieces to be arranged into their assembly positions and held there while they're permanently secured.

The shaping phase is analogous to many conventional forming processes used in the production of parts made from sheet plastics and metals. After softening the posing agent, the piece is deformed and allowed to harden again in its new shape.

If the geometry of the piece makes it difficult to ensure a consistent registration and deformation due to the piece shifting during the mold closing, it may be necessary to use registration points to position certain points of the piece at specified coordinates on the mold. It may also be desirable to use a gripping point to lock those positions in place during the molding process. If it is necessary to have registration points or gripping points, it may also be necessary to separate the motion of the gripping points from the motion of the mold halves, either via active articulation or passive spring-mounted motion.

Once the piece has been set on the mold, it is necessary to perform a softening-hardening cycle to set the textile into its new shape. The softening phase can occur prior to, during, or after the mold closes around the textile, but the hardening phase must occur after the mold has closed and before the textile has been released.

If the softening treatment is heat application, it can be applied in a number of ways. The mold itself can be heated, to heat the piece via conduction when the mold closes. Alternately the piece can be softened underneath an infrared radiator, it can be exposed to a blast of hot air, or passed across a heated roller or plate. It can also be softened more selectively with a scanning laser, directed jets of hot air, or by exposure to an infrared radiator that's masked to block some of the radiated heat. If the posing agent has been doped to make it receptive to electromagnetic radiation or induction heating, either can be applied to selectively heat the treated areas.

If the hardening phase requires that the formed piece be cooled while in the mold, that can be done by drawing the heat through the mold, assisted via active cooling in the form of circulating coolant, or a passive or fan-cooled heat sink.

The surface of the mold itself can also be a thermoelectric junction that heats the piece when current is flowing in one direction, and can then be immediately switched to cooling by reversing the flow of current.

It may be desirable to selectively soften the posing agent in some locations, while leaving it rigid in others. This may be to preserve delicate indicators and seams on the agents surface, or to reduce needless energy consumption. It can also be done to selectively alter the tension in the textile substrate, which will affect how it joins with other materials and the shape it will take while worn. For example, an elastic band ribbon for a sweatpants seam, treated with a posing agent, can be stretched to, and held steady at, the diameter of the pants so that it can be attached easily. After the posing agent is removed, the elastic band will return to its normal diameter, and the waistline will cinch, as per its design.

Figure 5:
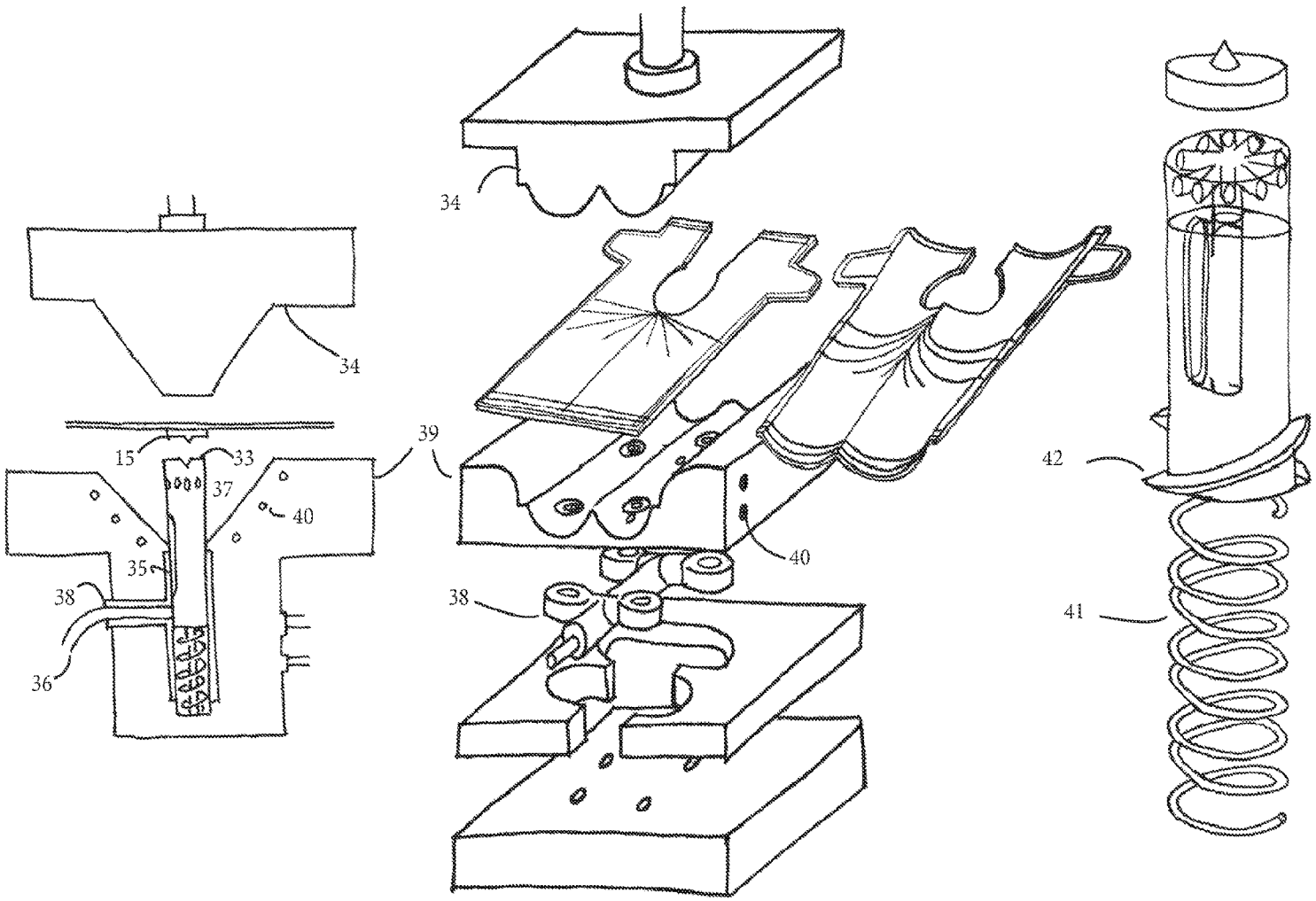
FIG. 5 depicts a mechanism for imparting a form to a material treated with a heat-softened posing agent.
Figure 6:
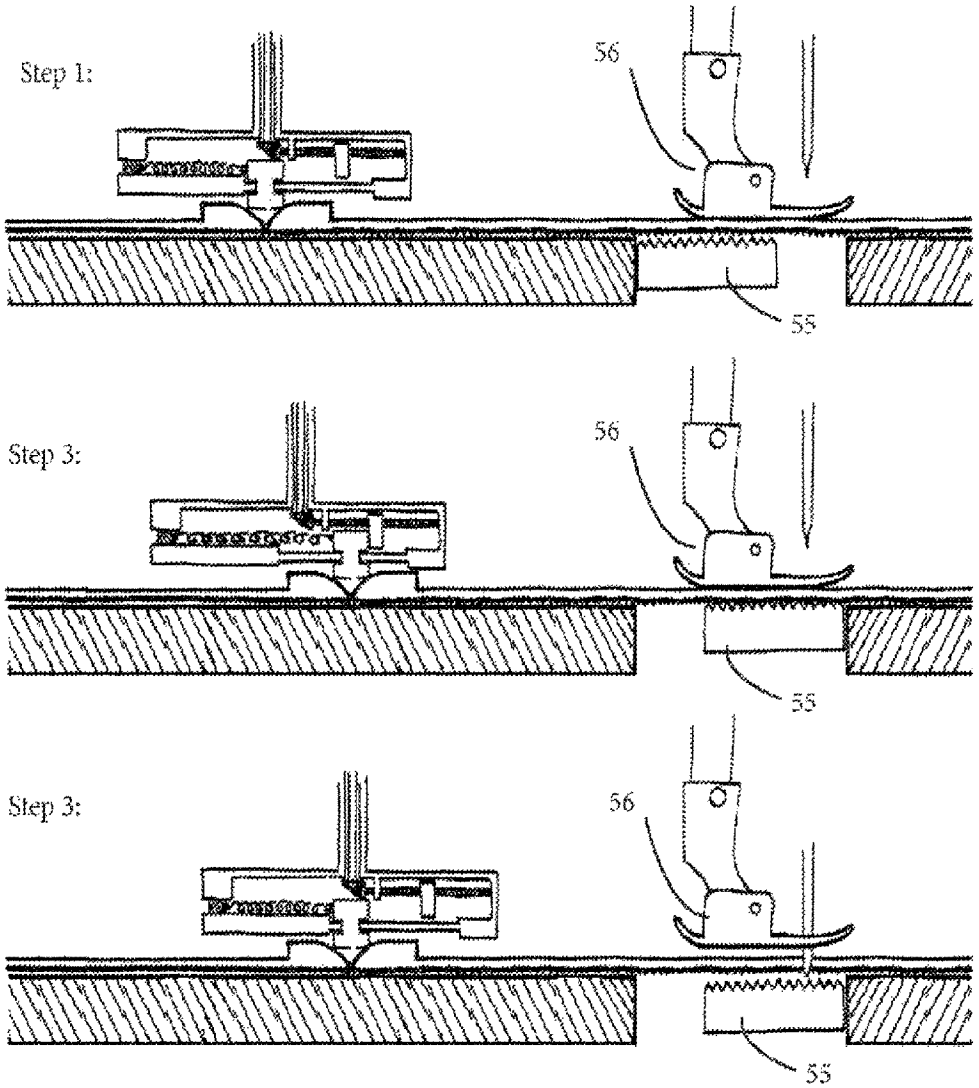
FIG. 6 depicts a stitch length compliance mechanism.
Figure 6:
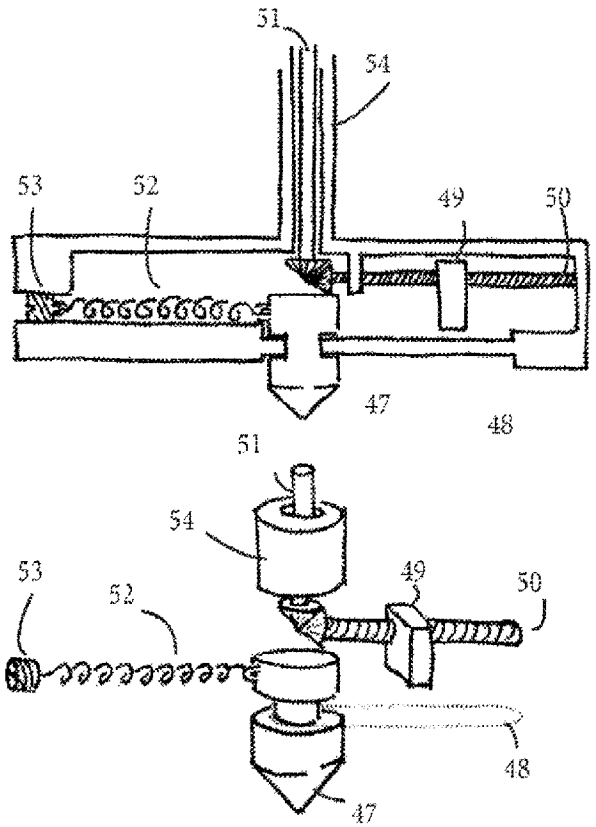

One mechanism for imparting a form to a material treated with a heat-softened posing agent is demonstrated in FIG. 5. A textile (1) treated with a posing agent (2) and augmented by a registration point (15) is placed onto a post with a mating registration point (33). When the forming die is closed, the top half of the die (34) compresses the post so that the valve (35) is opened, allowing hot air, originating from the heated, pressurized input (36) to flow out of the outlet nozzles (37) and across the surface of the posing agent, softening it. The ducts providing the heated, pressurized air through the cool mold are isolated by a layer of insulation (38).

As the piece is pressed against the bottom half of the mold (39), it is conformed to the desired shape. The bottom half of the mold is kept cold via circulating coolant (40), which cools and hardens the posing agent, allowing the piece to retain its imparted shape. After forming, the post is returned to its initial position via a spring (41). A helical groove along the length of the post (42) causes it to rotate with each stroke, so the hot air valve is not opened on the return trip.

It is intended that the interior faces of the mold halves be easily removable and interchangeable, such that the press can be rapidly retooled for use with a different pattern.

Other Forming Methods

The wide range of techniques currently used for working with sheet plastics and metals can be adapted to form the treated textile. This includes techniques like vacuum and pressure forming, which can be used to draw the softened textile tightly across a surface, so that it will preserve the desired shape as it's allowed to cool. Other metal forming tools, like press breaks for forming long bends (like pleats or hems) and rolling wheels can be used to manually or automatically impart curved surfaces.

Seam Flange Preparation

Depending on the thickness and strength of the posing agent, as well as the number of layers of agent and number of layers of textile that need to be sewn through, it may be necessary to prepare the seam for sewing. To this end, the posing agent can have perforations or troughs formed in its surface during the step in which the posing agent's thickness is determined, or it can be applied after the forming phase by stamping or rolling the posing agent with an appropriate die.

It may be necessary to thin the stiffening agent, and possibly the textile, to minimize the bulk of the seam during and after assembly. This can be done can be done by during an earlier embossing, etc., step or by passing the edge through a skiving machine, which will slice or grind off a thin, tapered layer of the posing agent or textile.

The face of the pre-seam surface must be aligned so as to be parallel with its corresponding face on the joined piece. The angular orientation of the seam flange can be determined in the main pressing phase, or in a subsequent step in which the face is remolded into place.

FIG. 3 demonstrates a prepared seam flange. The textile (1), treated with a posing agent (2), has been bent along its edges to correctly angle the seam flange (8) for its future mate. Additionally, the seam flanges have been thinned in anticipation for needle penetration, continually (19) and as a perforation (9).

Post Forming

After the form has been set, it may be desirable to treat the textile with agents to permanently set some of the features, like pleats, darts, or the shape of drapes, using permanent press treatments that are currently in widespread use.

After forming the piece, it may also be desirable to perform some of the steps described in the hemming and folding or surface features pre-forming sections, if their application needs to be deferred due to the possibility of the forming process damaging or deforming the hem, fold, or surface feature, or the possibility of the hem, fold or surface feature interfering with the forming process.

Assembly

Positioning

After forming, the pieces are gripped and positioned relative to each other using a specialized assembly effector, a static or actuated positioning jig, or a combination of the two. Gripping and registrations points can be utilized to ensure correct alignment between the assembly effector and the pieces, the pieces and other pieces, or the pieces and a positioning jig.

Garment pieces are held by an articulated jig effector via a vacuum, electromagnetic, or mechanical grippers, with their registration points used to correctly align the pieces with the jig. Radial and linear actuators allow precise control over the entire garment's, or individual garment components', spatial relationships with machines and other components of the garment.

The actuators on the effector can be used to manipulate the garment in a number of ways. Although relatively flat when grasped (Steps 1 & 2), the molded garment pieces can be folded back on themselves (Step 3). Once temporary joints or permanent seams are made (Steps 3 & 4), the partially assembled garment can be further manipulated to make otherwise inaccessible seams available to permanent joining operations (Step 5). This active repositioning is an alternative or compliment to the passive repositioning discussed later, in the "collisions" section.

Active repositioning can also consist of mechanically actuated faces or pneumatically expanded balloons, that—when activated—press against the inside of a seam, causing it to expand outward and be exposed to machinery.

Pinning

Once the pieces have been correctly positioned relative to each other, they can be joined together immediately, or pinned temporarily in anticipation of a subsequent joining step. Temporary joints can be contiguous along the length of a seam, or spot joins in key locations.

If the posing agent can be joined to itself, there are a number of options available for joining two pieces with at least one layer of posing agent between the two textiles to be joined. To form a joint, the posing agent must be softened prior to joint compression. If the posing agent is softened by heat, a sonic-, radio-, or laser transmission welding device can be used to heat just the posing agent at the boundary between the two materials.

If the posing agent cannot easily be joined to itself, there are other options available—the joint can be rolled over, like the top of a soup can, and held together mechanically, it can be joined with a temporary adhesive, or snap-clasp gripping points can be used to secure the pieces relative to each other. Furthermore, pseudo-permanent joins can be made using rivets, staples, or pins made from the same material as the posing agent, so that they can be easily removed at the end of the assembly process.

Sewing

Once the pieces have been positioned and secured, they can be joined together permanently.

Some accommodations may have to be made to the normal sewing processes, to account for the presence, thickness, and strength of the posing agent, as well as the fact that the posing agent is going to be removed after assembly, leaving a gap where it used to reside.

The issue of penetrating the posing agent with a sewing needle, if not entirely resolved by the application of trenches or perforations in the seam flange preparation step, can be further addressed by the use of a stronger needle and thread than would otherwise be called for. The posing agent can also be softened in advance of the needle. If the posing agent is softened by heat, the needle itself can be heated, or the agent can be softened by contact with a heated element, or exposure to a radiating heat source.

It is necessary to synchronize the motion of the seam being sewn with the action of the sewing machine. Given fine-grained enough control over the precise position of the assembly, the motion of the piece relative to the sewing machine can be broken down into steps that correspond with the desired stitch length, and moved from step to stitch in stitch with the sewing machine's motions.

If motion control systems are insufficiently accurate to allow for this, any elasticity in the treated textile can be exploited so that the movement of the piece through the sewing machine is equal to the average feed rate of the sewing machine, and during the periods of time in which the piece is moving against a static needle/presser foot, the tension is distributed across the garment.

Alternately, the garment can be grasped by an effector that allows for some degree of compliance along the seam's path, and can thus provide a motion buffer against the sewing machine. If this is the case, the effectors compliance vector's magnitude should not exceed the length of one stitch, and its direction should be limited to that of the stitch.

A tip intended to complement a registration point is mounted in a track that allows for 1 dimension of motion along the direction of compliance. A movable block is intended to limit the magnitude of the compliance, and is mounted on a screw, actuated by a drive shaft. A spring is mounted to the point opposite the direction of compliance to provide a resistance force and return the point to center. The spring's tension can be adjusted by turning a screw. The entire effector can be rotated by an external shaft, which controls the directional component to the compliance vector.

In use, we see a fabric (2) treated with textile (1) being pulled by a feed dog and presser foot in order to advance the textile one stitch length. The spring is distorted under the tension, and the piece is allowed to move forward the length of one stitch, regardless of the precise positioning of the effector that's moving the piece along at the average feed rate. This effectively buffers the stepped motion of the sewing machine against the continuous motion of the robotic arm.

Figure 7:
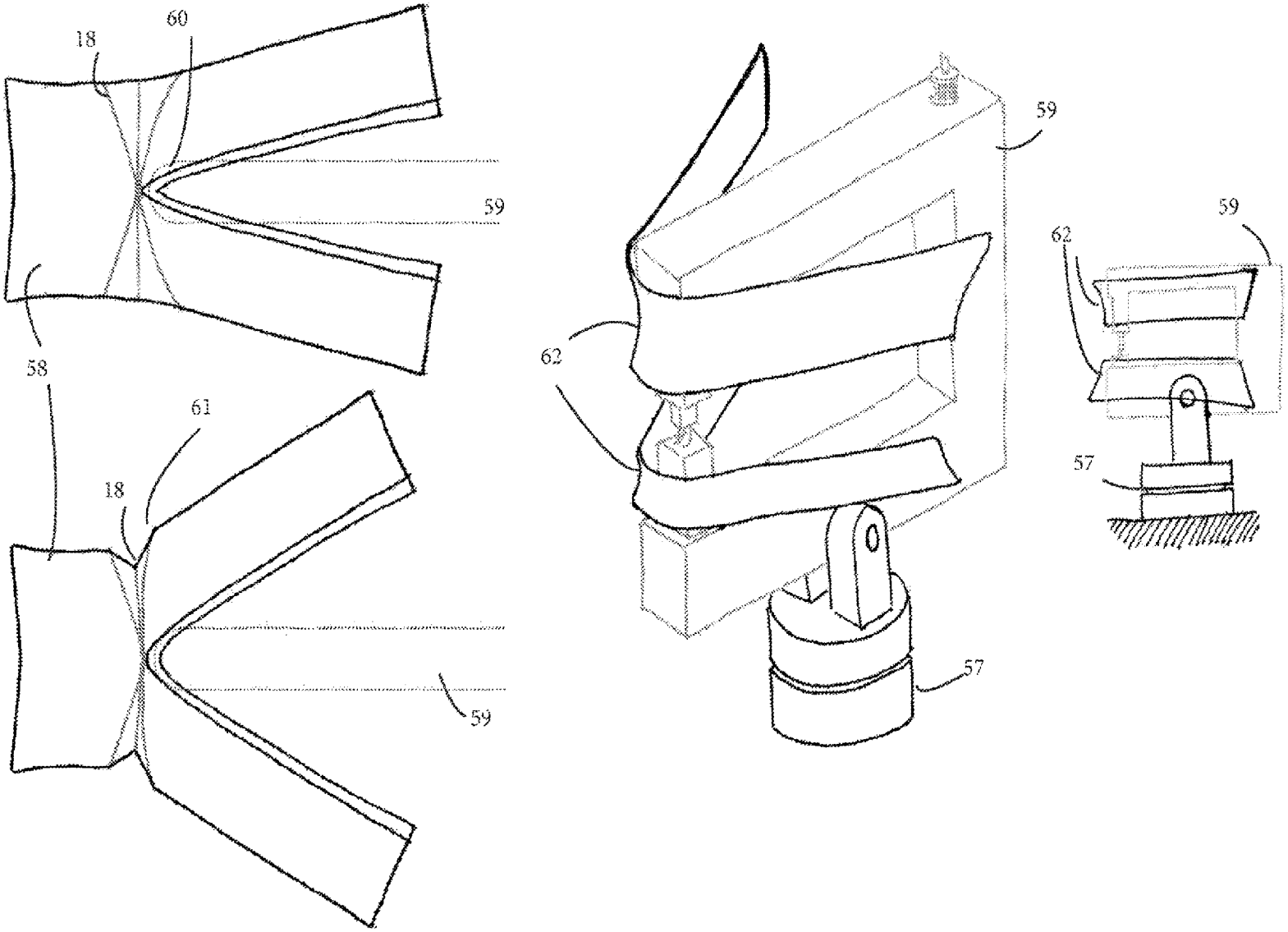
FIG. 7 depicts a guided deformation of a garment and a mechanism that can be used to adjust the orientation of a sewing machine to a garment.

In order to assist the manipulator that's feeding the garment through the sewing machines, it may be necessary to mount a sewing machine on mechanisms that can be used to adjust the orientation of the sewing machine to the garment, along numerous axis of motion. Such a mechanism (57) is depicted in FIG. 7.

Since the posing agent can take up a proportionally large amount of space between two layers of textile, it's necessary to consider the gap that will be left when the agent is removed. To compensate for this, it may be necessary to sew with a higher tension in the thread than one would otherwise use, anticipating that the tension will be relieved once the posing agent is removed. Alternately, the thread can be made of a material that will shrink slightly when exposed to the heat or humidity of the finishing, washing, and drying steps.

After each sewing step, or after several sewing steps, it's necessary to trim loose threads that may be present at the end of a seam. The high level of positional accuracy allowed by the posing agent and registration points allow the garment to be passed against an active or static cutting tool, possibly equipped with a vacuum duct, to cut and remove any loose threads.

It's worth noting an additional existing problem that's addressed by the application of a posing agent to the textile pieces. Multi-layered fabrics can suffer from seam distortion due to a differential in fabric feed rates, often due to low friction between fabric layers. This can cause seams to "pucker", which is undesirable, and is often resolved with complex machinery that attempts to apply the feeding pressure more evenly across all the layers. (Latham, 2008, p. 89) However, textiles treated with a posing agent could easily be fully bonded to each other prior to the seam stitching, and thus avoiding the need for complex machinery.

Non-Sewn Seams

Adhesives can be used in place of needles and thread to join two pieces together. Additionally, rivets can be used to reinforce or bind seams. Some synthetic textiles can be fused to themselves with sonic- and radio-welders, as well as heat sealing driven by hot air or contact with a heated element. Additionally, laser transmission welding can be used for this, by directing a beam of light at a frequency engineered to pass through the posing agent, but be absorbed by the textile.

If a textile seam is going to be fused, then it is important that the non-treated surfaces be mated to each other, a consideration that is not required for sewn joints.

Collisions and Realignments

For the purpose of this discussion, we'll use the term collision to describe any situation in which a stitch needs to be made in an area, or along a seam, which cannot be reached by the sewing machine due to interference from other elements of the garment.

During the sewing of tight corners (for example, at the armpit of a shirt or inseam of a pair of pants), it may be necessary to resolve collisions between the volume of the garment being assembled and the sewing machine being used. Although this is a trivial issue for traditional methods of garment assembly, in which the limp textile can be easily be bunched together or spread out and shifted relative to the machine to avoid any collisions, it becomes a more important issue to consider when the textile has been stiffened.

In the more straightforward collisions, articulation creases formed in the posing agent can allow the garment to deform elastically in a predictable and repeatable manner. The sewing machine can be fitted with deflection guides to aid in the deformation and restoration.

A straightforward example of a collision is depicted in FIG. 7, in which a garment (58) is fed into a sewing machine (59). The geometry of the garment is such that a collision occurs (60), where the garment is trying to occupy the same space as the sewing machine. Articulation creases (18) are employed to allow the garment to deflect from the collision (61), aided by deflection guides (62) affixed to the sewing machine.

In more complex assembly processes, in which the simple elastic deformation is insufficient to resolve the collision, it may be necessary to inelastically deform the garment using an intermediate pressing stage, similar to the initial piece forming process. During assembly, garments can be partially or wholly reformed to expose edges or create geometries that would not be otherwise present or accessible.

Intra-assembly remolding can also be used to align seams that were not mated in the garment pieces' initial positioning, due to limitations from piece geometry or the necessity of leaving a seam accessible to sewing machines. Subsequent remolding steps can distort finished seams to make others possible accessible.

Eversion

For most garments being assembled, up to this point all steps would have been performed with the garment inside-out. At the end of the assembly process, the garment must be everted into its final form for washing, pressing, folding, and packaging. A possible solution to this problem is proposed, consisting of a mechanism to effect the assembled garment's eversion onto a specialized frame.

In use, the assembled garment is placed adjacent and opposite to an eversion frame, and then the posing agent stiffening the garment is softened—either the entirety of the posing agent or just partially, in strategic locations. The garment is transferred to the eversion frame, which can be actuated as needed to ensure a complete eversion and correct placement of the garment on the frame.

Figure 8:
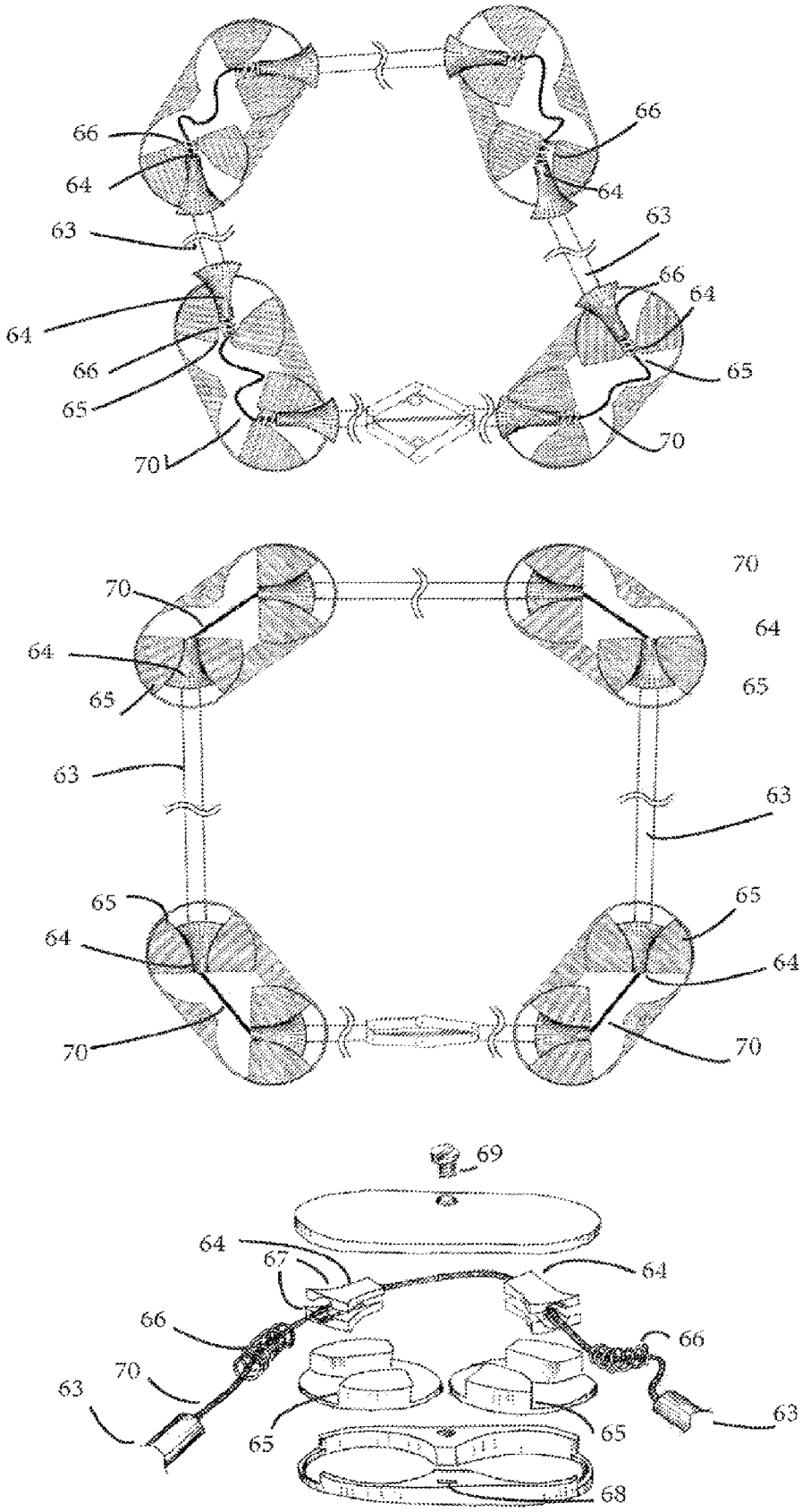
FIG. 8 depicts a collapsible eversion frame.

A collapsible, reconfigurable, eversion frame is depicted in FIG. 8. Telescoping segments (63) possess tapered tips (64) that mate with similarly tapered receptors (65). Biased springs (66) provide the ability to determine the default direction of the joint in the frame's collapsed 'slack state'. Rotary locking blocks (67), when compressed, lock the angle of the joint relative to the rest of the frame. The top of the joint mechanism possess a lip that acts against a fulcrum (68) to distribute the pressure exerted by a tension screw (69), which can be loosened to adjust any of the joints specifications, and tightened to 'lock' the position of the joint's components.

A tension line (70) runs throughout the frame, actuated by either the compression or decompression of the tension mechanism, depending on its configuration. If the line runs along the outside of the mechanism, compressing the mechanism decreases the tension in the frame, allowing it to go slack. If the line runs along the inside of the frame, compressing the tension mechanism increases the tension in the frame, causing it to become rigid.

Figure 9:
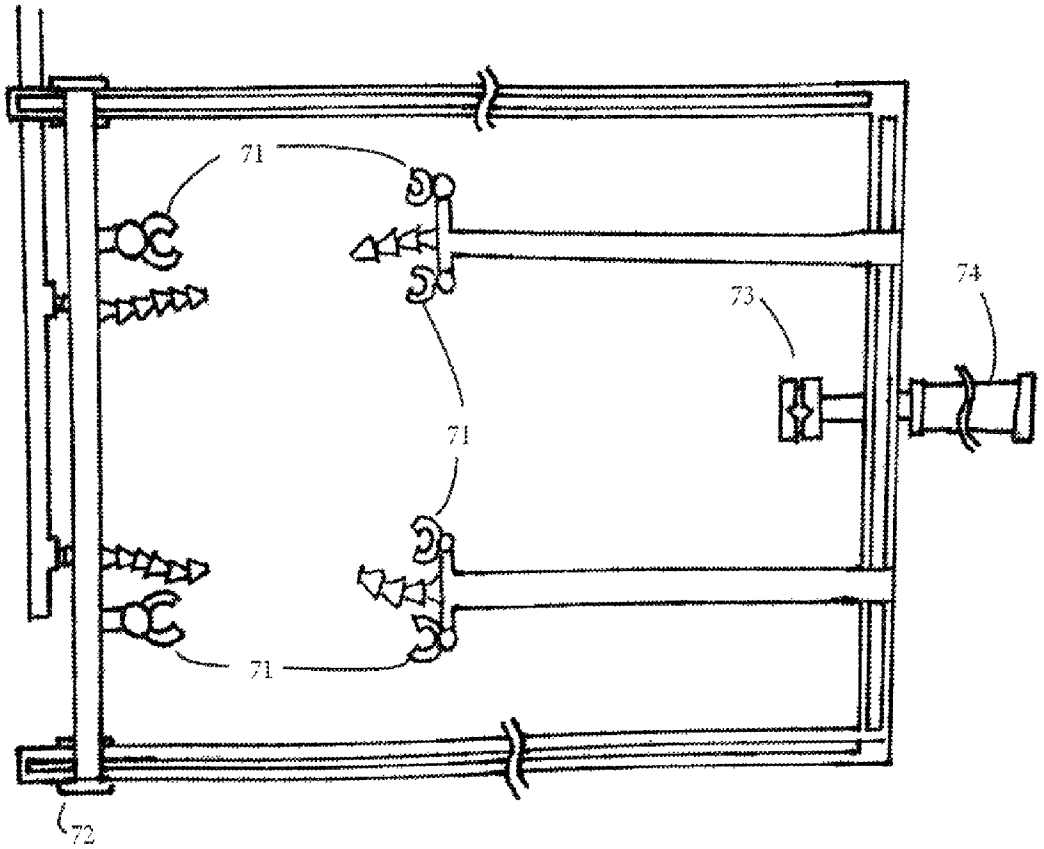
FIG. 9 depicts an eversion mechanism.

A mechanism to effect the final eversion is depicted in FIG. 9. Rotating grippers (71) are mounted on a sliding gantry that moves along tracks in the device (72). Positioned ducts direct jets of hot air to soften the posing agent. An actuated frame holder (73) holds the collapsible eversion frame in place during use, and a piston (74) is used to eject the garment and frame after eversion.

Figure 10:
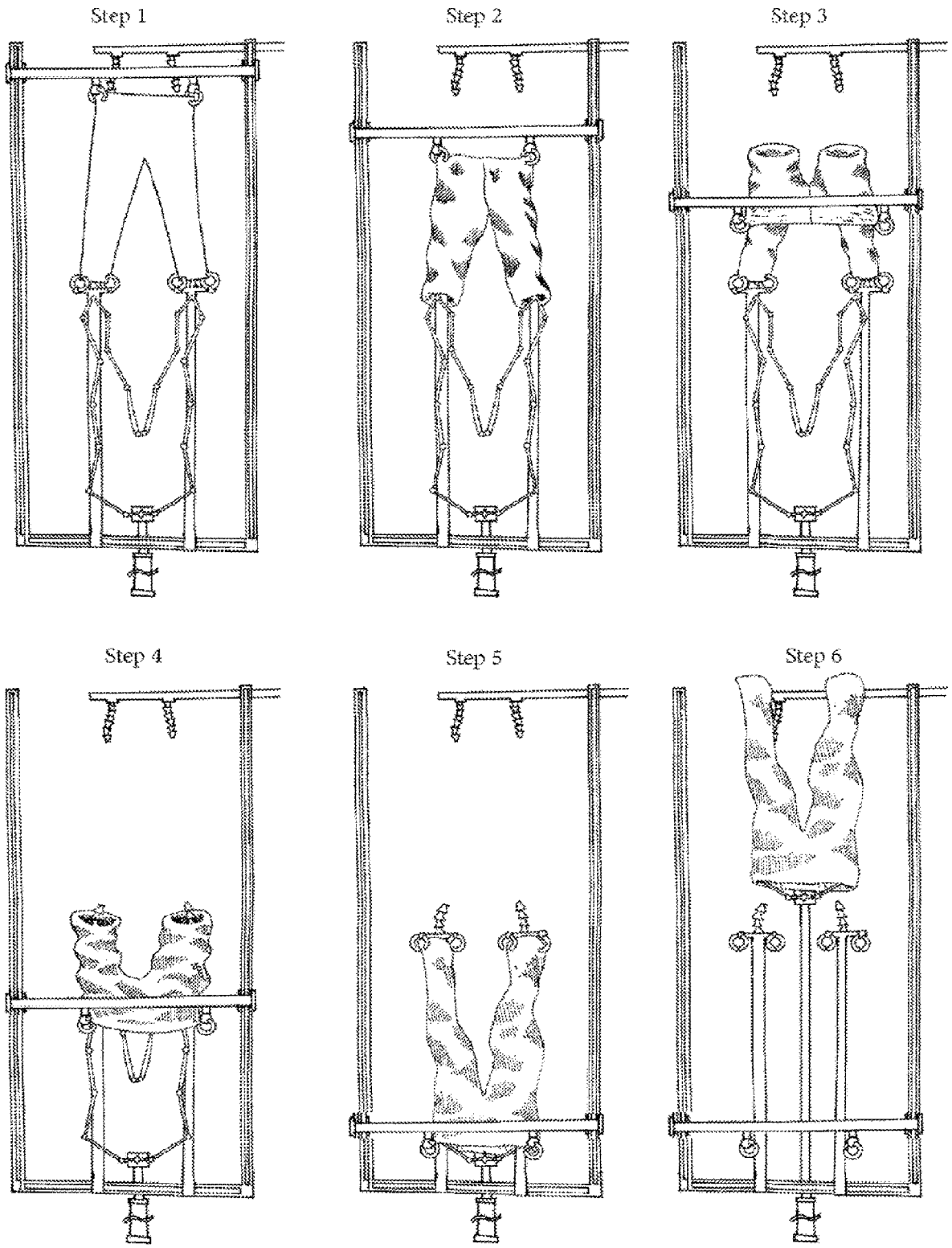
FIG. 10 depicts an example of a final eversion.

An example of a final eversion is depicted in FIG. 10. In Step 1, a garment is placed on an eversion machine. As the gantry moves the rotating gripping points along its path, the garment is pulled along and onto the frame, as seen in Steps 2-5. In Step 5, the eversion the frame is ejected, and then passed along to the washing phase.

Although demonstrated here in two dimensions, the eversion and drying/stretching frame could also be employed to achieve three-dimensional forms, with segments rotated off of the primary plane, including segments forking off into multiple axes. Separate frames used alongside each other in the same garment could be used for a similar effect.

Washing and Packaging

After the garment has been assembled, it is necessary to remove the posing agent. If the posing agent is water soluble, this can occur in conjunction with the washing step—if not, the agent must first be removed before the garment can be washed, most likely via exposure to an appropriate solvent or the modification of environmental conditions.

The garment stays on the frame throughout the washing process, and the same articulation mechanisms used to aid eversion can be used tighten and slacken the frame during washing, allowing the water and/or solvent full access to all the garment's surfaces, and then apply tension to the textile during the drying phase and any subsequent surface treatment steps to prevent wrinkles and inconstancies in treatment.

After the garment has been washed and dried, the frame can be used to position the garment on a pressing device—either ejecting the garment onto it, or holding it in place during pressing. After the garment was been pressed, it can be deposited onto, or fed directly through to an automatic folding and packaging machine, which are already in general use.

Quality Control

Input Material Prep and Standardization

A high level of consistency in the input materials is required for a high level of consistency in finished products. This is desirable for many reasons related to professionalism and consumer preferences, but for the purposes of this process a high degree of consistency is particularly important for minimization of false negatives in downstream-automated quality assurance sensors. Even if slight variations in the finished product would be undetectable to consumers, they must still be minimized to allow for tighter tolerances when using automated quality assurance inspection techniques.

Depending on the source and starting consistency of the input materials, it may be necessary to standardize them prior to the main manufacturing processes. The manufacturing inputs that can or need to be standardized are the textiles, threads, and any additional components that are going to be assembled (zippers, buttons, etc.), the posing agent that's applied to the textile, and the water that's used to remove the posing agent and clean the final products after their assembly.

Thermoplastics are often produced and sold in a range of molecular weights/degree of polymerization and—in the case of Polyvinyl Alcohol (PVOH)—degrees of saponification and hydrolysis. (ZSchimmer & Schawrz GmbH & Co KG) These variations can affect the mechanical and chemical properties of the plastic—including, most importantly, the melting point and the rate of dissolution of the plastic—and should be analyzed to ensure that the plastic's properties falls within the expected ranges. Inconsistencies can be compensated for when possible, by varying the duration and temperature of the washing steps, otherwise the plastic must be discarded.

Textiles and thread introduced from external suppliers can vary slightly from batch to batch. Subtle variations in color and surface character between pieces of an assembled garment would be visually discordant and undesirable to consumers, so care must be taken to measure and note any variations in color or surface characteristics, resulting from slight differences in the bleaching, dyeing, or treatment of the material. If a large difference is detected, then attention should be given to ensure that pieces cut from that textile source are not joined with parts cut from dissimilar textiles, sorting and storing pieces accordingly.

The resting tension of textile is determined by the characteristics of the loom and the particulars of the process that's used to dry the textile after any subsequent dying and washing steps. If there are variations in the textiles' tensions, it may be necessary to re-wash and dry the incoming textile so they have the exact same tension. This will also ensure a standardized amount of shrinking after subsequent washing steps.

The solvent that's used to remove the posing agent after assembly should be analyzed to ensure purity and concentration. Care should be taken to minimize any contaminants that would interact with the garments being assembled, or diminish the quality of the recovered size, like mineral content or chemical contamination.

To maximize consistency during every manufacturing step, all input materials can be stored in a temperature and humidity controlled environment so their starting states will be consistent. The manufacturing environment can also be temperature and humidity controlled to preclude any variations in these attributes that may arise over time, with changes in season, weather, etc.

During traditional garment manufacture, the hands-on nature of the process allows workers to do quality control as they perform other assembly steps. In a fully automated assembly process, automated quality control becomes an important factor to maintain a standard level of quality during high-volume production.

Simple Quality Assessments

Relatively simple measurements can be interpreted to provide quality control information—a weight sensor can measure a finished or partially assembled garment and determine if the correct amount of textile is present, or if any buttons are missing. A sensitive enough scale can even determine if the correct amount of thread was used during assembly.

A moisture sensor can determine if the garment was sufficiently dried after the washing step.

A metal detector can check for any metal shavings or broken needles present in the garment, or if there were any metallic registration points that were not removed along with the posing agent.

A finished garment that fails any of these simple tests can be automatically ejected from the assembly line and passed along to operators for further inspection.

Complex Quality Assessments

More complex quality assessment techniques can be applied at various stages during production.

Raw Material Analysis

As discussed earlier in the description, it is important to identify flaws in the raw textiles, so that they're not passed along to cause quality control issues in finished garments. High-speed video cameras and inline scanners, coupled with machine vision systems, can locate defects such as tears or discoloration in the material. A strong backlight in visible or infrared wavelengths can be coupled with such a system to provide a measure of material integrity and consistency.

Scales and sensors can be used to determine if the textile possesses the required weight, thickness, elasticity, and density; and can thus provide an indicator of overall quality (or, at least, be used to indicate inconsistencies).

Intra-Assembly Seam Inspection

Machine vision can be used to evaluate seams as and after they are created on a garment, either by analyzing the thread in the seam relative to the pieces it runs through, or the overall spatial relationship between the two pieces that are joined by the seam.

The relationship between the two pieces can be evaluated using commonly used digitization techniques: Machine vision along a seam can check for misalignment, while a laser scanner or digitizing probe can evaluate more subtle flaws in the specific shape of the assembled garment.

Thread inspection can be assisted if necessary by treating the thread with a UV-fluorescent dye and activating it for inspection.

Pre- and Post-Folding

Since the structural support provided by the posing agent can prevent flaws in the garment from being detected, an ideal time to evaluate the quality of an assembled garment is after it has been pressed and either before or after it has been folded.

Machine vision analysis of light reflected off the finished garment at a number of angles can provide useful information like the overall dimensions of a garment, the presence of seam quality issues like pucker, and the integrity and correct placement of any decorative or functional elements. If the thread has been treated to fluoresce under UV light, then that can be applied as well.

The internal structure of the garment can also be probed with an analysis of light in visible and non-visible wavelengths that are transmitted through the garment. This can be infrared or x-ray. If the sensor is of high-enough resolution, individual thread placement can be evaluated.

Also as discussed earlier, utilizing machine vision for quality control is highly dependent on tight tolerances during assembly, and near-perfect consistency for post assembly steps like pressing and folding. If the variations in the (correctly assembled) garments' presentation to the Quality assessors are too severe, then they will produce false negatives and negate the utility of the quality control system.

Feedback

Some assembly issues may occur due to unexpected causes like input material inconsistencies, environmental variations, and machine wear and tear. In an ideally automated environment, the quality control systems will detect these changes as they develop and compensate in real-time without additional intervention. If the detected flaws are outside of the system's ability to compensate, it will automatically pause assembly and alert an operator to the cause of the disruption.

If the quality control mechanism detects issues with seam characteristics, like pucker or too little tension in the threads, a feedback mechanism can send a signal to the sewing machine to adjust the tension and spacing of the threads in real-time to compensate.

Since the washing and drying stages are energy intensive, there will be efficiency incentives to minimize the time a garment spends in the washer and dryer. If too little time is spent, there may be a residue of the posing agent in the garments leaving the washing stage, or too much water left in the garments leaving the drying stage. Sensors can detect these issues by weight, optical characteristics, and moisture sensors and send signals to adjust the garments' washing and drying time accordingly.

If the system determines that the parts are misaligned, and can quantify the degree of misalignment, it can then feed that information back to the arm control systems to correct for the error.

Non- and Semi-Autonomous Implementations

Although this document has primarily been discussing its processes with regard to fully autonomous manufacturing operations, it's worth considering the benefits that posing-agent treatments can provide in the cases of only semi-autonomous and even fully manual garment manufacturing operations.

The same benefits of simplified handling and improved precision that facilitates automated machine handling of textiles would also be useful to a human worker, who could use posing agents to ease his task in a number of ways.

This can aid smaller-scale manufacturing operations, during the design process of garments, or for single-garment custom tailoring. Limp fabrics, when treated and softened, could be wrapped around dress forms or models and sculpted while setting to attain the perfect shape and cut. Seams could be formed, and temporarily fastened with spot-welds in instead of the commonly used straight pins. This eliminates both the time required to insert the pin, and the risk of leaving the pin in the garment and accidentally pricking a customer. Although the final sewing operations would be done by hand, the task is simplified by the fixed positioning of the pieces relative to each other.

In the case of using this technique during the design and development process for larger production runs, instead of sewing the finished garment can then be washed, so that the pieces become separated, and then laid down and traced or scanned to create a pattern for forming duplicate garments.

Additionally, it's worth considering a scenario in which garments that are too complex for fully-automated manufacture are partially manufactured by automated processes and then handed over—either with or without posing agent—to human workers for the required operation—and then, if the process requires it and the posing agent is still present on the garment, handed back to the machine for further work. If the posing agent has been removed, then the garment can be handled by machines requiring a greater degree of operator guidance and intervention than those used while the posing agent was present.

Example

To assemble, as an example, a pair of pants, the first step is to fuse the textiles with the posing agent.

After it's been added to the textile, the posing agent is then be textured as needed, by compressing it under an embossing cylinder. Next, any functional surface features (gripping and registration points, etc.) are added to the roll by a pick and place mechanism and welding apparatus.

After the posing agent and surface features have been added, the garment pieces can be separated from the textile with a plotter or rolling die cutter. They're collected, sorted, and fed through to the assembly line.

Any pieces cut from alternate textiles, like linings or interfacings, can be prepared simultaneously or separately.

A robot grasps a large piece, comprising one of the pants legs, and places it onto the work area. The robot, or secondary robots, then place any additional pieces that need to be attached to the first piece, and can be attached while flat. This would include a pocket, an elastic band, a label, etc. After placing each piece, a spot-welding mechanism melts their interface with the posing agent and temporarily fixes them in place.

The robot then moves the piece through sewing machines to permanently join the added components. At this time, the robot finishes any necessary edges by feeding them through overlock sewing machines or sewing machines equipped with folding guides.

A robot then lifts the piece and positions it adjacent to a vacuum-equipped cutting surface so that any loose threads can be trimmed.

The robot then transports the piece to a forming machine, which heats, deforms, and cools the piece so that it acquires the desired shape. The deformed piece is then removed from the forming machine and folded, along its existing crease line, against itself.

A complementary piece, the other pant leg, is then mated with the first piece. Their seams are temporarily tacked by spot welders, and then are joined permanently by sewing machines. The immediately accessible seams are sewn first, and then inaccessible seams are made available, and sewn up, by articulating the appropriate segments of their assembly jig.

The assembled garment is then placed atop an eversion mechanism, opposite to an eversion frame. The eversion mechanism's grips hold the garment at its extremities. Directed nozzles soften the posing agent with an application of hot air. The gantry mechanism pulls the garment's top down over the eversion frame, until it has been turned completely inside out and is containing the frame.

The frame, and garment on it, are ejected from the eversion mechanism and picked up by a conveyor that moves the garment through its washing and drying cycles so that the posing agent is fully removed. During the washing cycle, the eversion frame is slackened so that the garment is somewhat free to mingle with the solvent, but during the drying phase the frame is tense so as to pull the garment tight and minimize wrinkles.

The washed and dried garment is pulled off of the eversion frame by rollers, and is passed through a quality inspection station. If the garment checks out, it is then deposited onto a folding and packaging machine.

Although specific embodiments and details have been disclosed, it is intended that this patent in addition cover methods, products and processes that would be apparent to a person of skill based upon the present disclosure. To that end, the invention is described in the following claims.

What is claimed is:

1. A working material, comprising:

a textile substrate comprising a seam flange; and a posing agent in solid form temporarily laminated to the textile substrate, wherein the posing agent is removable by applying one or more solvents and without damage to the textile substrate, wherein the posing agent is thinned along the seam flange of the textile substrate.

2. The working material of claim 1, wherein the posing agent is rigid and applied to the textile substrate resulting in a pattern that yields bend lines, which are substantially free of posing agent, along which the working material may be bent.

3. The working material of claim 1, wherein the posing agent is a thermoplastic that melts or substantially softens at or near room temperature.

4. The working material of claim 1, wherein the posing agent is thinned along a full length of the seam flange.

5. The working material of claim 1, wherein the posing agent is thinned along the seam flange continually.

6. The working material of claim 1, wherein the posing agent is thinned along the seam flange with a plurality of perforations.

* * * * *